US005655574A

United States Patent [19]

Warnecke

[11] Patent Number: 5,655,574

[45] Date of Patent: Aug. 12, 1997

[54] STREAKLESS APPEARING WOVEN FABRICS

[76] Inventor: Hans O. Warnecke, 201 Princeton Blvd., Adairsville, Ga. 30103

[21] Appl. No.: 613,380

[22] Filed: Mar. 7, 1996

Related U.S. Application Data

[62] Division of Ser. No. 440,307, Apr. 11, 1995, Pat. No. 5,538,047.

[51] Int. Cl.[6] ..... D03D 27/06

[52] U.S. Cl. ..... 139/383 R; 139/398

[58] Field of Search ..... 139/383 R, 405, 139/398, 403

[56] References Cited

U.S. PATENT DOCUMENTS

| | | | |
|---|---|---|---|
| 749,219 | 1/1904 | Pearson | 139/398 |
| 2,714,902 | 8/1955 | Hoselbarth | 139/403 |
| 3,322,163 | 5/1967 | Hughes | 139/383 R |
| 3,519,032 | 7/1970 | Sabbe | 139/398 |
| 3,570,552 | 3/1971 | Carrigan | 139/405 X |
| 4,846,230 | 7/1989 | Mock et al. | 139/383 R |
| 5,152,326 | 10/1992 | Vohringer | 139/383 A |
| 5,454,405 | 10/1995 | Hawes | 139/383 A |
| 5,473,981 | 12/1995 | Mazaki | 139/383 R |
| 5,518,042 | 5/1996 | Wilson | 139/383 A |
| 5,538,047 | 7/1996 | Warnecke | 139/21 |

*Primary Examiner*—Andy Falik

[57] ABSTRACT

Streakless appearing woven rugs incorporating large uninterrupted areas of a single color are formed by at least two ends of yarn of the same color alternating in the face of the rug along each of the longitudinal rows in the uninterrupted area. The two ends of yarn may alternate in an ordered or random pattern, and suitably may alternate at least every twelve inches.

7 Claims, 7 Drawing Sheets

STREAKLESS APPEARING WOVEN FABRICS

This application is a divisional application of U.S. Ser. No. 08/440,307, filed Apr. 11, 1995 U.S. Pat. No. 5,538,047.

1. BACKGROUND OF THE INVENTION

My invention relates to the weaving of textiles having large continuous areas of a single color. My invention has particularly useful application to weaving processes for pile fabrics such as carpets and rugs, that can incorporate more than one color. The invention eliminates the undesirable streaking along the length of woven fabrics that frequently occurs when an off-color warp end is woven into a large single color area of the fabric. As used in the industry an "end" of yarn resents a continuous "length" of yarn.

Perhaps the single greatest unsatisfied need within the area rug industry today, and through the ages, is the construction of multicolored rugs having large uninterrupted areas of single colors. Border rugs and children's rugs, such as those illustrated in FIGS. 2 and 3 hereof, are typical of the type rug to which I am referring. Large uninterrupted areas are designated in FIGS. 2 and 3 as 10, 11, 12, and 13. There is a tremendous commercial potential if quality versions of these type rugs can be produced economically. Prior to the present invention a method had not been devised to adapt modern tufting or weaving techniques to produce quality versions of these type rugs economically.

Weaving and tufting, which are the two predominant means for manufacturing rugs, have until now been unable to produce quality versions of these rugs economically. Tufting machines have been unable to satisfy the commercial demand for these type rugs because, with the exception of a few commercially unproven tufting machines, tufting processes cannot produce rugs that change color along the length of the rug. While color can vary along the width of the rug, each row of tufts along the entire length of the rug must remain the same color.

Because there is a market for rugs that change color along their length, the tufting industry has for years attempted to develop a tufting machine with this capability. Tufting machines that employ more than one needle at each tufting position along the width of a rug, or that are capable of varying yarn types in individual needles during the tufting process, would conceivably be able to change colors along the length of the rug. Indeed, these type machines are well known in the art. For instance, Spanel, (U.S. Pat. No. 3,554,147) discloses a tufting machine wherein each needle is fed a tuft of yarn from one of three yarn positions before each tufting stroke. Kile (U.S. Pat. No. 4,549,496) discloses an invention embodying the same concept. Boyles (U.S. Pat. No. 3,172,380) discloses a tufting machine having a plurality of tandem arranged needles that are individually actuable at each tufting position. To my knowledge none of the foregoing inventions has proven able to economically produce the type rug with which my invention is concerned on a large scale, because they are too complex and impractical. Accordingly, it is the practice in the tufting industry, when it is desired to produce tufted border rugs of two solid colors, to mend four individual pieces of one color of rug to the exterior of another rug piece of another color, to form a rug similar to that shown in FIG. 2. This is a labor intensive, expensive method. Moreover, mending is impractical when the design of a rug is any more complicated than a border rug, such as children's rugs as in FIG. 3 with which my invention is also concerned.

Weaving looms are ideal for the construction of border rugs and children's rugs because of the ability of jacquard weaving looms and other weaving looms to incorporate many colors in a rug along the length of the rug according to any designated pattern. Indeed, the only limitation on the design a jacquard loom can create is the number of colors the loom can practically incorporate. Oriental design rugs, one of the most popular type rugs produced by the weaving process, exemplify the versatility and capabilities of weaving looms. FIG. 3 is a drawing of a woven rug that also illustrates this versatility. The weaving loom suffers from the drawback, however, that if an off-color end of yarn, or warp, is integrated into the fabric for a substantial distance, it will appear as an undesirable streak throughout its length. Along the width of a woven rug there are a multiplicity of warp ends integrated in lines through the entire length of the rug. Each end of yarn is pulled from a separate bobbin. In a rug having a large uninterrupted area of a single color, there are thus multiple ends of identically colored yarn woven side by side through the length of the large uninterrupted area. If one end of yarn is even slightly off color it will appear as a prevalent streak in the rug in contrast to the other yarns that surround it. It has been observed that the streak is most prevalent in bolder yarn colors such as navy blue and forest green, colors that are in popular demand today.

The streaking in woven rugs produced by discolored yarn is a problem of historic proportions in the weaving industry that, until my invention, had not yet been overcome. This problem has existed since rugs and other fabrics were first woven, which authorities date back to before the ancient Egyptian civilization. Warp ends incorporated into a rug can be off-color for many reasons, but the color of a warp end is a product generally of two factors: (1) the quality and color consistency of the fibers incorporated into the yarn; and (2) the texture and fiber distribution within individual yarn ends. Numerous patents are accordingly aimed at reducing the variability associated with these two factors. Ruggiero, et al. (U.S. Pat. No. 5,360,457), Kelly, et al. (U.S. Pat. No. 5,358,537), and Hemling, et al. (U.S. Pat. No. 5,120,326), for instance, each disclose methods for improving the yarn fiber dying process, for more consistently colored yarn fibers and yarn, ends. Kawanchi (U.S. Pat. No. 5,276,083), and Leons, et al. (U.S. Pat. Nos. 5,040,276 and 5,327,622), similarly disclose methods to produce consistently textured yarns. These inventions, among other technological advances, have improved the quality and color consistency of yarns and reduced the streaking problem with which my invention is concerned.

Despite these advances, however, yarn manufacture remains an inexact science, and off-color yarns are still frequently manufactured. For this reason other industry leaders have focused their resources to identify off color yarns before they are sold to textile manufacturers. Such inventions are disclosed and discussed, for instance, by Coons (U.S. Pat. No. 5,195,313), Hendrix, et al. (U.S. Pat. No. 3,929,013), and in "NTC is making quantum leaps in research projects", *Textile World* (May, 1994, Vol. 144, No. 5, p. 46). Even these efforts have not solved the streaking problem entirely, however, because even if every yarn end is perfectly color consistent before incorporation into a rug, an end of yarn can end up off-color once incorporated into the weave, because the texture (and hence color) of a yarn end is influenced by the tension with which it is pulled into a loom, and a loom pulls yarn ends from different bobbins at different tensions. Bobbins are pulled at different tensions because of a number of factors, including the angle from which the yarn ends are drawn into the loom, the manner in which the yarn ends are threaded into the loom, and even the amount of yarn that remains on a bobbin. Yarn ends drawn in a straight line, such as yarns 4*a*, 4*b* and 4*c* shown in FIG. 1, are drawn under less tension that other yarn ends. The yarn ends that are drawn at greater angles to the weaving loom are typically drawn under greater tensions, which tensions influence the texture of the yarn, and cause the yarn ends to become discolored.

Some inventions have been developed to equalize yarn tensions to reduce the yarn tension effect I have just described. Coons and Vickery (U.S. Pat. No. 5,221,059), for instance, disclose an apparatus to overcome this variable tension problem, that equilibrates component tensions in a multicomponent filamentary yarn of the type used in a weaving loom. This invention can be used principally during backwinding of bulked continuous filament yarn. Vandeweghe, et al. (U.S. Pat. No. 4,736,776) discuss the use of a mobile backrest to even out warp thread tension within the loom. As with all the other foregoing developments, however, these inventions suffer from their complexity, size, and capital expense. Coons and Vickery, and Vandeweghe, suffer from the additional fact that inconsistent color yarns woven with these devices are still colored inconsistently upon incorporation into the rug. To my knowledge, because of these impediments neither of these inventions has been integrated with a weaving loom to produce streakless rugs of the type with which my invention is concerned.

As the foregoing illustrates, many efforts have been made over the years to improve the consistency in the color of yarns manufactured, and to ensure that yarns having a high color consistency are not compromised by the weaving process. To my knowledge, however, manufacturers remain unable to produce perfectly color consistent yarns, and looms remain incapable of applying uniform tension to yarns and not discoloring yarns. Accordingly, the efforts by the weaving industry have failed to produce consistently streakless rugs, and weaving manufacturers remain unable to weave a color consistent rug in which a streak will not appear.

The weaving industry has accordingly devised several solutions to the streaking problem that simply work around it. Generally, rugs are designed and patterned, as in oriental rugs, so that one color does not travel in the face of the rug a significant distance, and so does not manifest itself as a streak if it is off color. If a manufacturer desires to produce a rug of one color in a large area, his choices have been either to manufacture such rugs with streaks or to incorporate other colors and designs into the large one color area to break up any streaks. FIG. 7 illustrates a typical children's rug manufactured according to this method, that incorporates in an alternating pattern dots throughout the rug that reduce the length any yarn end travels in the face of the rug. The pattern in FIG. 7 does not solve the streaking problem, and it does not enable weaving manufacturers to produce rugs with large single color areas that today are in commercial demand.

As the success of the tufting industry at selling border rugs produced by a second mending process demonstrates, a technique for producing woven rugs of the type I have described in a continuous mechanical loom would be commercially valuable. It is to this end that the present invention is directed.

2. SUMMARY OF THE INVENTION

I have devised a process by which textiles, particularly rugs and other pile fabrics, can be woven to incorporate large uninterrupted areas of a single color without the streaking appearance that is irrevalent when traditional weaving techniques are employed. The process is most advantageous because it does not require any modification or structural change to a weaving loom, it does not require any equipment purchases, it relies on standard quality yarn ends, and it can be practiced on any type loom capable of incorporating more than one color in a longitudinal row through the length of the rug. My invention relies on the observation that an off-color yarn becomes more predominant the longer it travels in the face of a rug, and becomes less predominant the less distance travelled. The process of my invention requires that no end of yarn travel in the face of the rug for a significant length.

As a fabric is being woven and a yarn end is woven into the face of a fabric, before the distance of the yarn end in the face of the fabric reaches a significant length, the yarn end is pulled from the face of the rug to float on the back of the rug as the weaving process continues. Meanwhile another end of identical color takes the place of the floating yarn end, and is woven into the face of the rug along the same longitudinal row, also for no more than a significant length. By alternately incorporating these identically colored yarn ends into a longitudinal row in the face of the rug an off-color yarn will not travel far enough in a continuous line to manifest itself to the human eye as a streak. By pulling the same color yarn from two creel positions in every longitudinal row of a single colored area, and alternating between the two positions in every longitudinal row as I have described, streaks do not appear in any part of the rug.

3. DESCRIPTION OF THE DRAWINGS

Turning now to the drawings.

Figure 5:
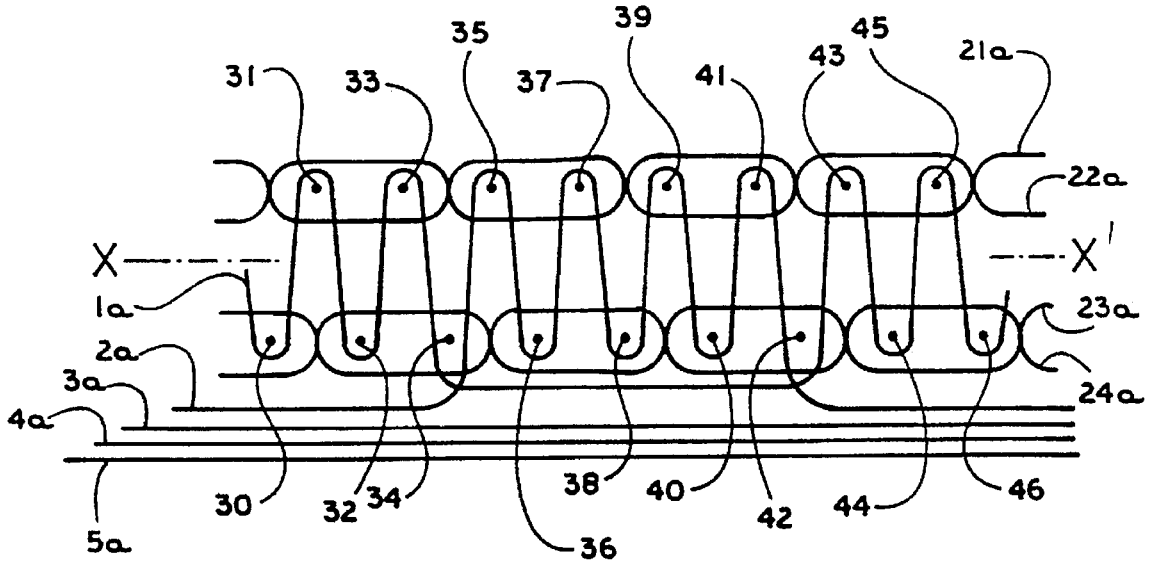
FIG. 5 depicts a cross-sectional view of a fabric woven according to my invention, having a double weave, wilton construction.
Figure 7:
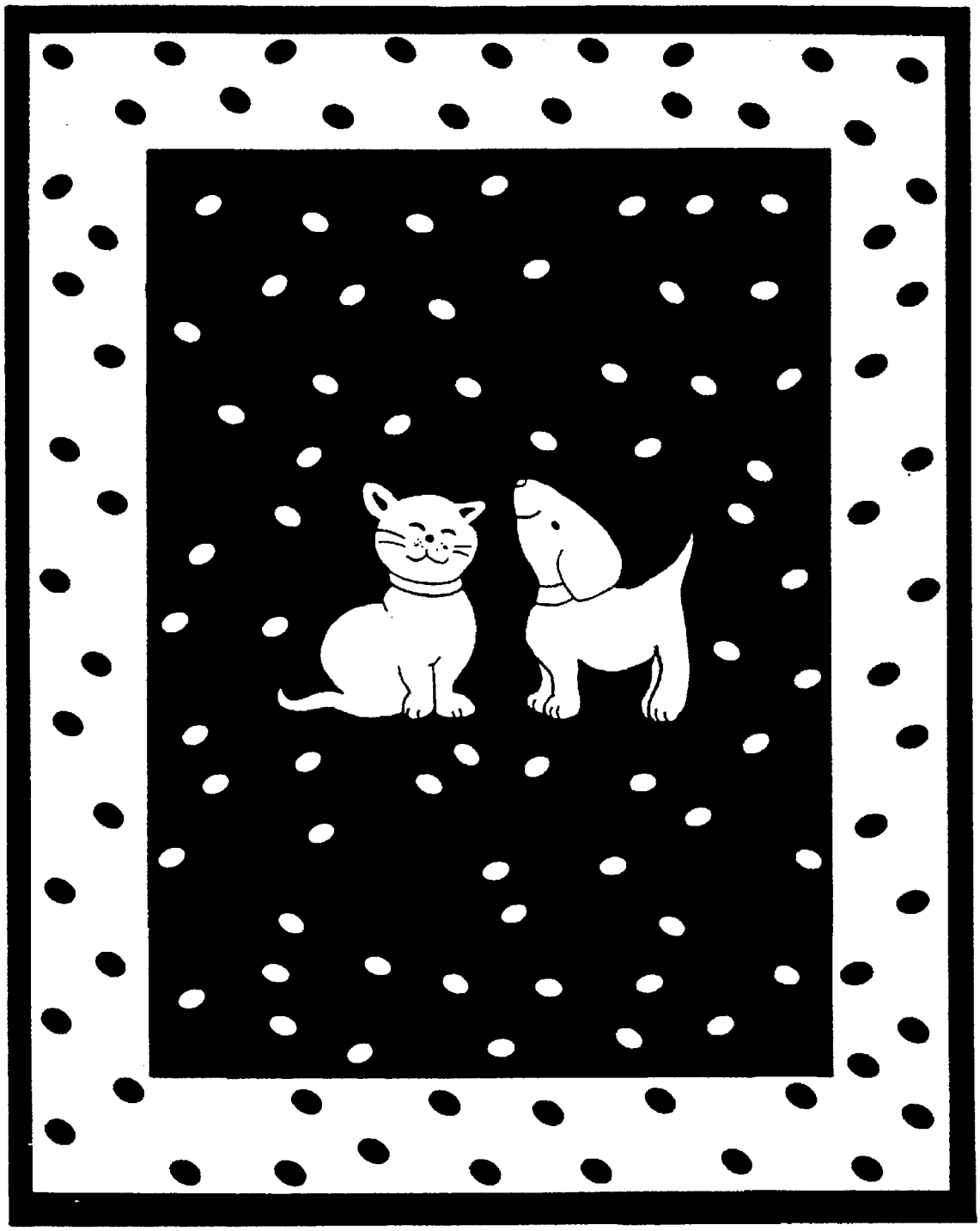

FIGS. 6(*a*)–6(*d*) depicts a sequential illustration of the weaving of the fabric in FIG. 5;

FIG. 7 depicts a children's rug of the type design generally produced today by the weaving industry, having dots woven into the continuous areas of the rug to break up any streaks.

4. DETAILED DESCRIPTION OF THE PREFERRED EMBODIMENT

Fairchild's *Dictionary of Textiles*, Sixth Ed., defines "weave" as "[t]he method or process of lacing two yarns or similar materials so that they cross each other at right angles to produce woven fabric. The warp threads or ends run lengthwise in the fabric, and the filling threads (wefts or picks) run from side to side." A cross-sectioned view of a fabric woven according to a double weave, wilton construction is illustrated in FIG. 5, wherein yarns 1*a*, 2*a*, 3*a*, 4*a*, and 5*a* represent five warp ends or "pile yarns." Yarns 1*a*, 2*a*, 3*a*, 4*a* and 5*a* can be incorporated at different stages along the length of the fabric into the face of the fabric to impart different color to the fabric. These "pile yarns" are typically five different colors so that five different colors can be worked into the fabric. Yarns 30–46 constitute a series of picks about which a warp end is alternately laced in each longitudinal row of the fabric. Yarns 21*a*, 22*a*, 23*a* and 24*a* represent the binding yarns that hold the backing of the fabric together. My invention hag particular application to the production of pile fabrics and rugs having this type double weave, wilton construction. Rugs woven according to this construction are cut along the x–x' axis to produce two rugs from one piece of fabric, shown as 9*a* and 9*b*in FIG. 1, each having a face corresponding to a plane formed by the x–x' axis as it extends through the width of the fabric.

The weaving process for a double weave, wilton construction rug is accomplished according to the sequential illustration in FIGS. 6*a*, 6*b*, 6*c*, and 6*d* (collectively referred to as FIG. 6). In this weaving process each of the five pile yarns is threaded through a heddle that can raise and lower the pile yarn from the other pile yarns as is shown in FIG. 6. Though the heddles are not shown in FIG. 6, they are illustrated generally in FIG. 1 and denominated by numeral 8. The pile yarns are "pulled" through a loom all at the same rate in the direction of the arrows shown in FIG. 6. Each of the five pile yarns corresponds to a "position" on the creel. A loom that has a five color capability thus "pulls" yarns from five different "positions." A position can only hold yarn of one color. Thus, every longitudinal row in a fabric can only incorporate the same colors as another longitudinal row.

As the five pile yarns are pulled through the loom they are separated into two sets of yarns as in FIG. 6 when a heddle lifts one of the pile yarns. The area between the two sets of pile yarns into which a pick 33 is shown to have been inserted in FIG. 6*a* is known as a shed, designated by numeral 15. A reed 14 encloses the shed.

Figure 6A:
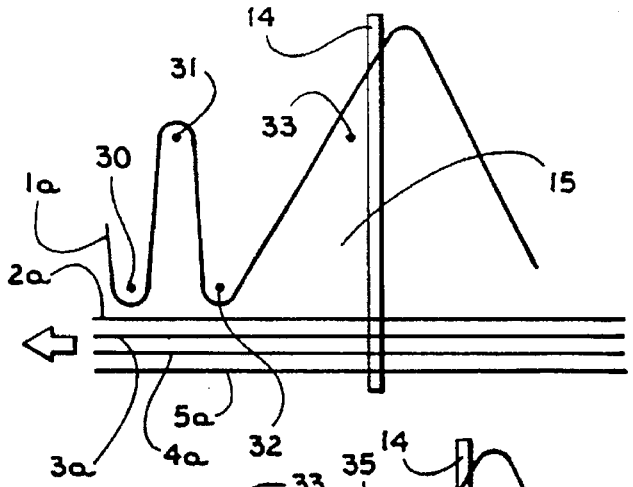
Figure 6B:
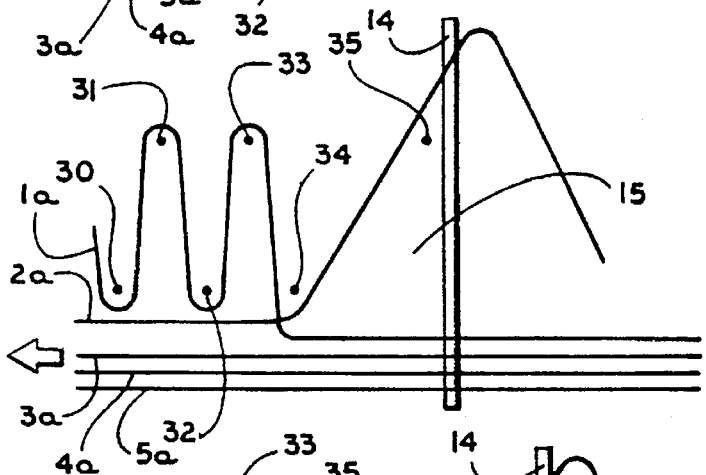

In FIG. 6*a* pile yarn 1*a* is shown to have been lifted by a heddle (which is not shown). At this point a pick yarn 33 is shot through the shed as in FIG. 6*a*. The reed then beats pick 33 into place against the upper side of the finished fabric. When the reed retracts the heddle returns pile yarn 1*a* in line with the other pile yarns, whereupon another pick yarn 34 is shot above the line of yarns, and beaten by the reed against the finished fabric. Only one heddle is activated each cycle. In FIGS. 6*a*, 6*b*, 6*c* and 6*d* the four pile yarns corresponding to heddles not activated are shown to float along the back of the bottom side of the fabric.

Though it is not critical to this invention, with the use of certain looms some or all of the pile yarns could float along the top side of the fabric, and they could be woven by the binding yarns into the back of either the top side or bottom side of the fabric. This type weave wherein the floating yarns are woven into the backing is known as an "incorporated" weave.

Figure 6C:
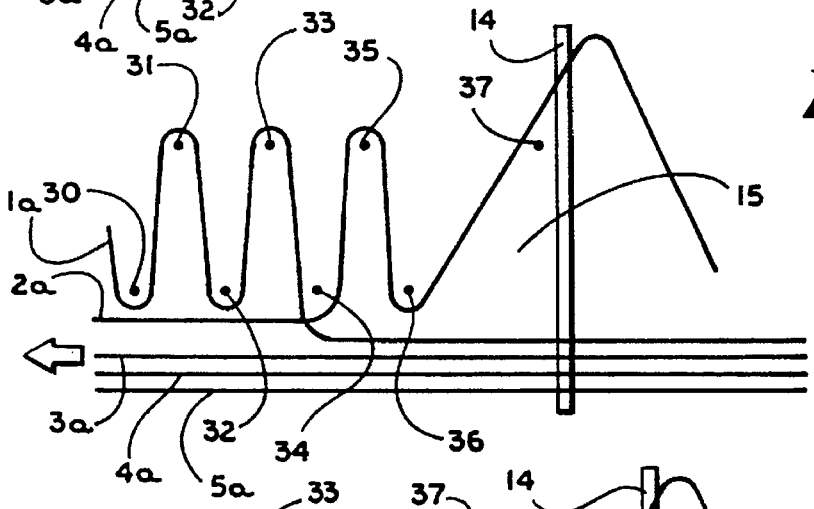
Figure 6D:
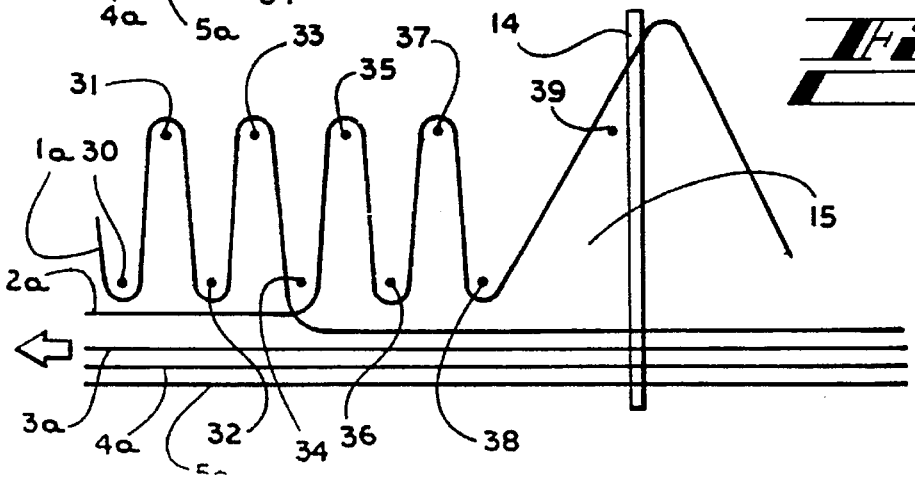

By alternately activating heddles and corresponding pile yarns between cycles the different pile yarns can be incorporated into the face of the fabric. Thus, in FIG. 6*b* pile yarn 2*a* is shown to have been lifted by the heddle through which it is threaded. Pick yarn 35 is then shot through the shed, the reed beats pick yarn 35 against the finished fabric, the reed retracts and the heddle returns pile yarn 2*a* into line with the other pile yarns, and another cycle is completed. Now, however, woven into the face of the fabric at one "point" is the color corresponding to pile yarn 2*a*. FIGS. 6*c* and 6*d* show the continued integration of yarn 2*a* into the face of the fabric according to the cycle I have just described.

By use of this method the color of the fabric in a longitudinal row can be changed along its length. Thus, in FIG. 5, them is shown a longitudinal row incorporating yarn colors corresponding to pile yarns 1*a* and 2*a* into the fabric. By alternately activating heddles and corresponding pile yarns in each longitudinal row according to a predetermined pattern, rugs of varying patterns can be woven according to this construction. The heddles can be alternated by use of a jacquard mechanism, or other modern electronic control mechanism. These mechanisms are well known in the art and need not be addressed herein.

The operation of the reed has not been shown because it is unnecessary for an understanding of the operation of my invention. Neither have I shown the process of shooting picks through the fabric, or lacing in binding yarns 2*a*, 2*b*, 2*c* and 2*d* because these processes also are not necessary to understand my invention. The operation of the reed, of the shuttle for shooting picks, and the process for lacing in the binding yarns are in wide use and well known in the art, and are incorporated into looms manufactured by, for instance, Michael Van De Weile NV of Belgium.

Figure 1:
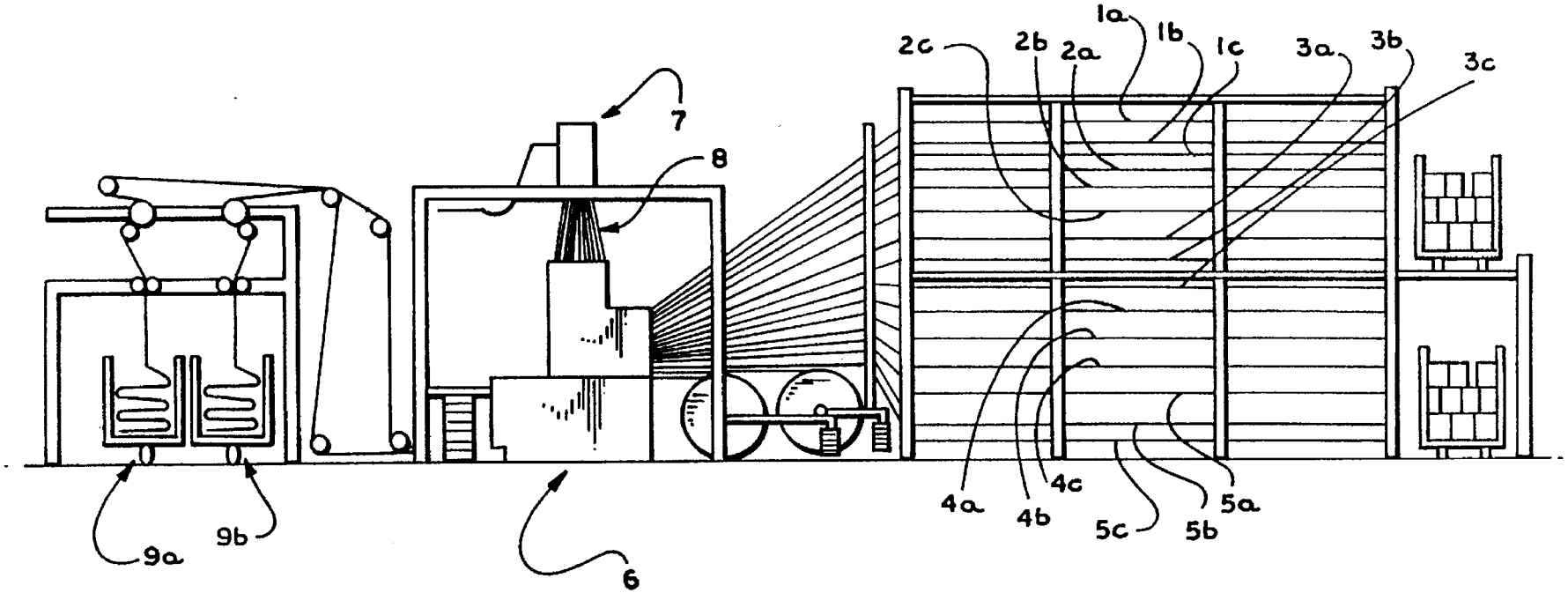
FIG. 1 depicts a simple view of a loom.

Most commercial looms in operation today employ a five or six position creel. Because each position bears one color of yarn pile a loom bearing a six position creel is capable of generating rugs having six different colors incorporated therein. The pile fabric illustrated in FIG. 5 has five filler yarns, and thus was produced by a loom as in FIG. 1 bearing a creel having five positions, one position corresponding to each pile yarn. Each position comprises a series of bobbins bearing the same color yarn pile. Each bobbin from an individual position supplies one row of woven pile along the length of the rug. In FIG. 1 filler yarns 1*a*, 2*a*, 3*a*, 4*a* and 5*a* are shown as representative filler yarns being pulled into the loom. These filler yarns correspond to those shown in FIGS. 5 and 6. In actual practice, for a rug having 1,200 rows across its width, each position of the loom must bear 1,200 bobbins of yarn pile, as opposed to the three bobbins for each position shown in FIG. 1. A rug having 1,200 rows across its width, and having six colors, must have six positions and a total of 7,200 bobbins of yarn. As mentioned previously, each individual bobbin is threaded through a heddle.

I have devised a process that manufactures streakless appearing rugs without any costly structural modifications to the foregoing mechanical implements, and relies only upon a novel and unique manipulation of the foregoing processes to mass produce quality versions of multicolor fabrics having large continuous areas of single colors economically.

It has been observed that the less distance an off-color pile yarn is woven into and travels through the face of a rug the less prevalent is the streak within a rug produced by this off-color pile yarn. I have devised a process that applies this concept to weaving, in order to weave streakless appearing rags having large areas of one color. My process requires that the loom be set up with the same color yarn on two positions of the creel, so that the same color pile yarn is pulled from two different positions of a creel. Once a loom has been threaded, two of the heddles dedicated to each longitudinal row are thus threaded by the same color yarn from different positions in FIGS. 5 and 6, for instance, filler yarns 1*a* and 2*a* would be of the same color. As a rug is being woven, the jacquard or other heddle selection mechanism thus has two ends of the same color pile yarn, filler yarns 1*a* and 2*a*, with which to construct each longitudinal row of a single colored area. By alternately incorporating the two filler yarns of the same color into each longitudinal row along the face of the rug, streakless appearing rugs can be manufactured. Such an end product is illustrated in FIG. 5, if filler yarns 1*a* and 2*a* are the same color. Likewise, FIGS.

6*a*, 6*b*, 6*c* and 6*d* give a sequential illustration to the steps of my invention if filler yarns 1*a* and 2*a* are of the same color.

It has been found that the streak produced by an off-color pile yarn that travels an insignificant distance in the face of the rug is not perceptible to the human eye. Thus in the process of my invention no end travels in the face of the rug a significant distance. Although this distance can vary according to the color of yarn and the degree to which an end is off color preferably no end travels in the face of the rug in excess of about twelve inches.

It has been found advantageous in certain looms to vary the length each pile yarn end travels along the face of the rug. Thus, filler yarns 1*a* and 2*a*, if of the same color, would be woven into the face of the rug at varying intervals. It has also been found advantageous to vary the intervals for identically colored filler yarns in each longitudinal row independent of the intervals of the identically colored filler yarns in other longitudinal rows. Looms that do not incorporate the floating yarns into the wilton backing, or that draw pile yarns from positions or bobbins at varying tensions, are prone to producing defective rugs if this embodiment is not practiced. These looms are accordingly especially benefitted by this embodiment of my invention.

The bottom rug of a face-to-face fabric manufactured by a loom having a nonincorporated wilton design backing loses a point of yarn in the face of the rug every time the pile yarn is alternated. This is because a pile yarn will only remain in place in an unincorporated backing if it forms a complete "U" around a pick yarn, and when yarn ends alternate, only ½ of a U protrudes from the backing of the fabric. If these pileless points form a row across the width of a rug, as for instance when the longitudinal rows alternate pile yarns at the same point along the length of a rug, the row of points manifest themselves as a streak across the width of the rug.

Other problems result in looms that apply variable tensions to pile yarns pulled from different positions, which can discolor the yarn. Accordingly, in looms in which the pile yarns from different positions are pulled into the loom at different tensions it is desirable to prevent large areas from incorporating yarn from only one position, because these blocks can appear in the face of the rug. These blocks can also be prevented by alternating yarn ends in each longitudinal row at intervals independently of the alternating pattern in other lengthwise rows, as disclosed by my invention.

Figure 2:
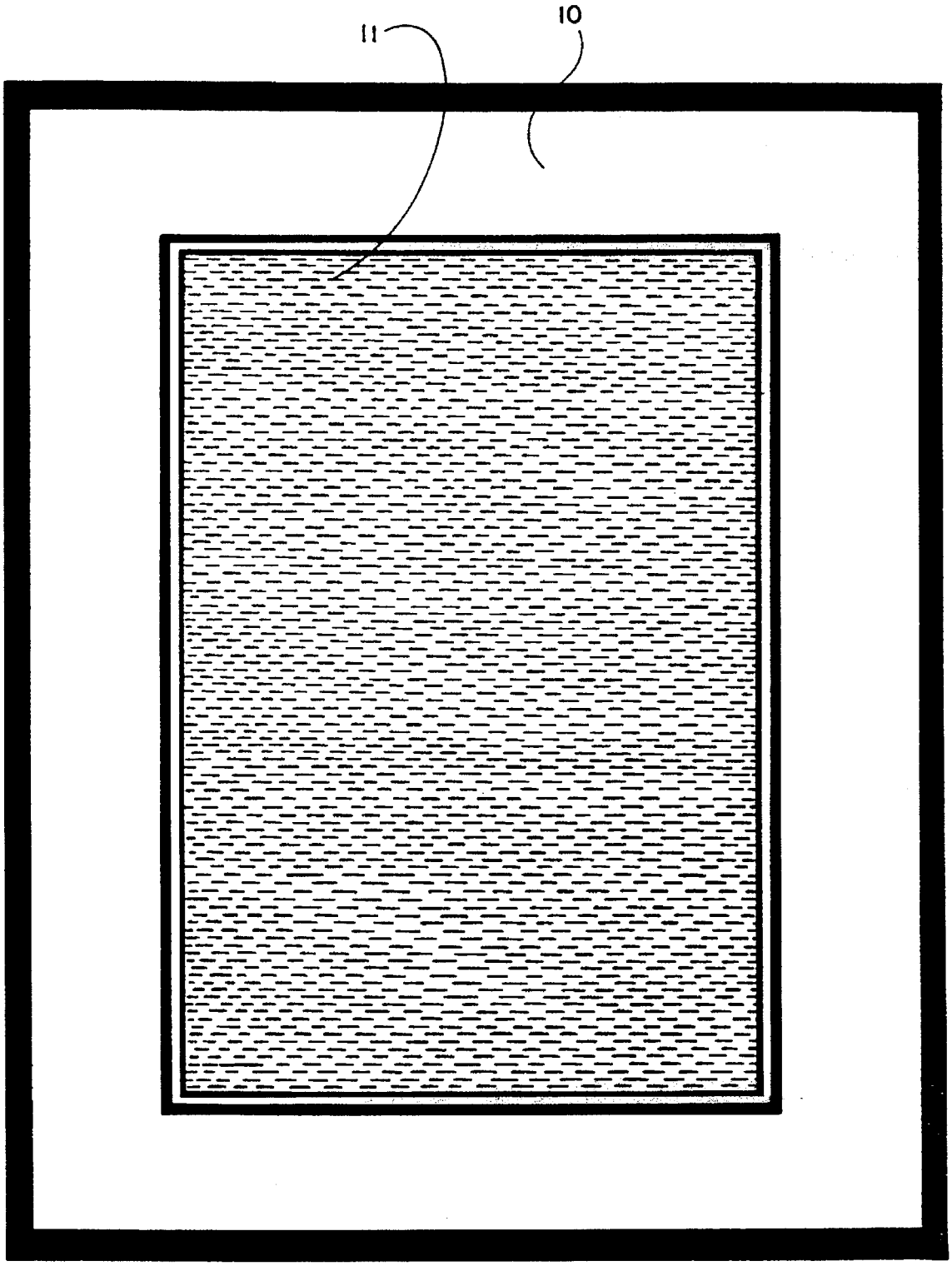
FIG. 2 depicts a border rug of the type with which my invention is concerned.
Figure 3:
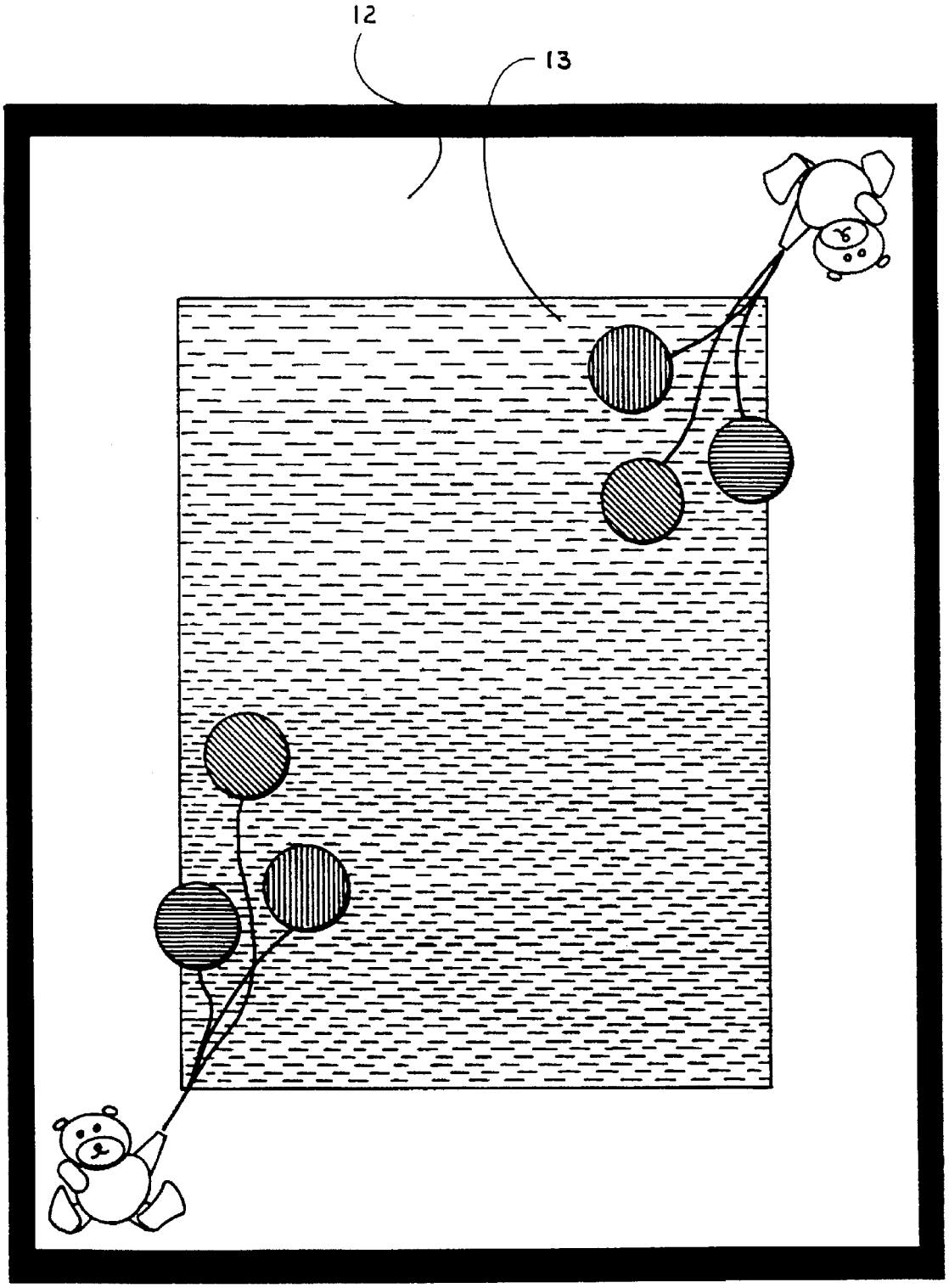
FIG. 3 depicts a children's rug of the type with which my invention is concerned.
Figure 4:
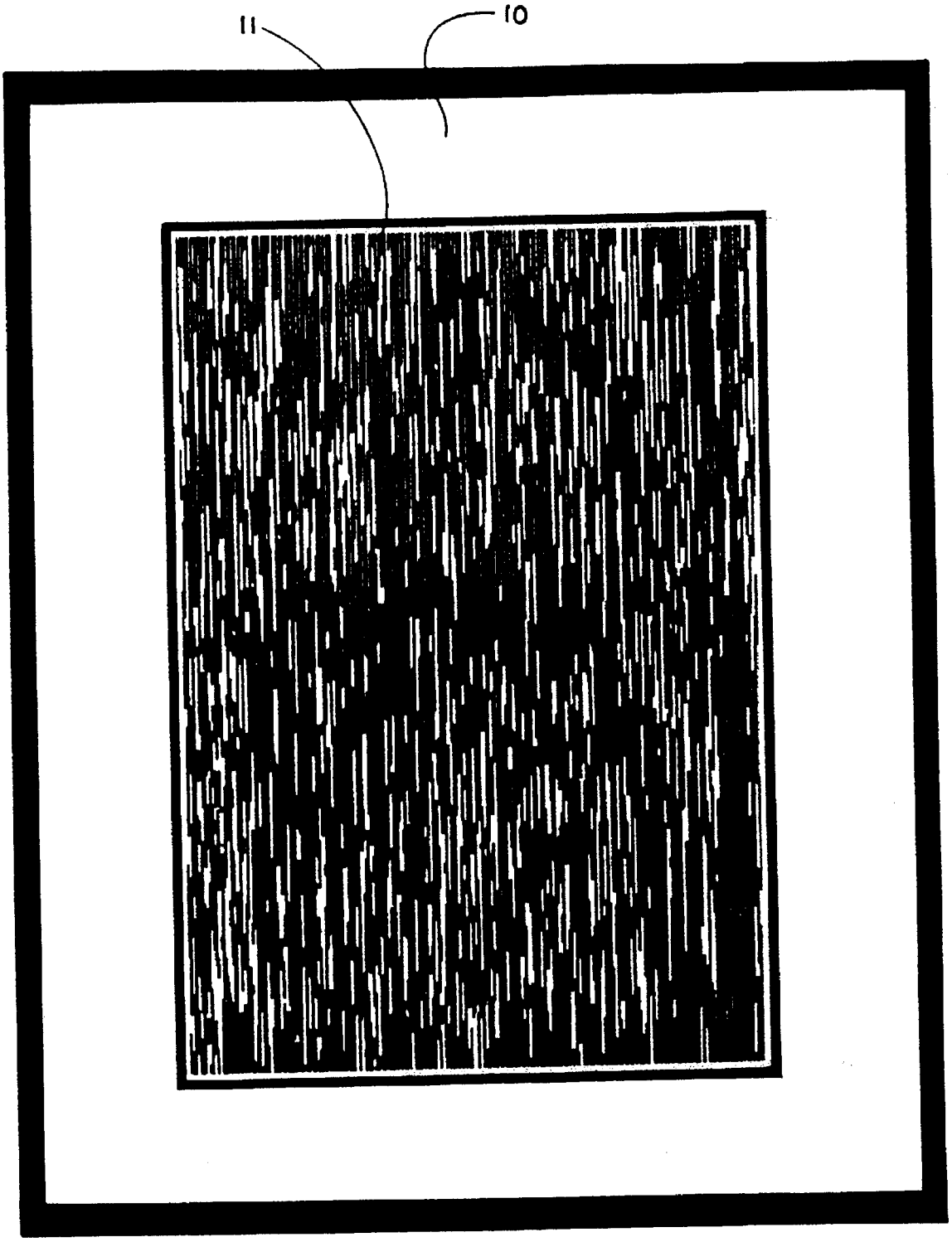
FIG. 4 depicts the border rug shown in FIG. 2 conceptually displaying yarn from only one position incorporated into the center area of the rug.

FIG. 4 illustrates one variant of this preferred embodiment of my invention that overcomes the problems presented by the type looms I have just discussed. FIG. 4 illustrates part of the face of a rug manufactured according to this embodiment, conceptually showing in area 11 only the portions of the rug that would be filled from one of the color positions. During the actual weaving of the rug shown in FIG. 4 the other color position would fill what is shown in area 11 of FIG. 4 as a blank area, to produce an area 11 of uniform color as shown in FIG. 2. Thus, in FIG. 4 filler yarns are shown to travel in the face of the rug at varying intervals in each longitudinal row, and filler yarns are also shown to travel in each longitudinal rows according to varying intervals that are independent from the varying intervals from other longitudinal rows. This embodiment has been shown to both eliminate the effect of the loss of pile points in a non-incorporated bottom rug, and to eliminate any detectable visual defects from pulling yarns from different positions at different tensions.

It will be appreciated that the weaving industry has evolved over millenniums, and that during such time many variations in weaving methods have been developed. While my invention has particularly useful application in the weaving of rugs according to the construction described herein, those skilled in the art or weaving fabrics will appreciate that my invention can be applied to fabrics woven by other than a double weave, wilton construction. Indeed, my invention can be used in any loom that can weave more than one warp end into a single longitudinal row of the fabric. Accordingly, this invention is meant to embody all weaving methods in which the process described herein can practicably be carried into effect.

I claim:

1. A streakless appearing woven fabric comprising:

a) a continuous area of a single color in the face of the fabric;

b) longitudinal rows of yarn in the continuous area; and c) more than one warp end of the same color woven into each of the longitudinal rows of yarn in the continuous area, thereby precluding an off color yarn from travelling far enough in a continuous line to form a streak; and d) wherein, in each of the longitudinal rows, the warp ends alternate at varying intervals.

2. A woven fabric as in claim 1 wherein, in each of the longitudinal rows, the warp ends alternate at least every twelve (12) inches.

3. A woven fabric as in claim 2 herein wherein, in each of the longitudinal rows, the warp ends alternate at said varying intervals within the at least every twelve inches.

4. A woven fabric as in claim 1 herein wherein, in each of the longitudinal rows, the warp ends alternate at random varying intervals.

5. A woven fabric as in claim 2 herein wherein, in each of the longitudinal rows, the warp ends alternate at random varying intervals within the at least every twelve (12) inches.

6. A woven fabric as in claim 1 herein wherein, in each of the longitudinal rows, the warp ends alternate according to a frequency or pattern independent from the alternating frequency or pattern in any other of the longitudinal rows.

7. A woven fabric as in claim 2 herein wherein, in each of the longitudinal rows, the warp ends alternate within the at least every twelve inches according to a frequency or pattern independent from the alternating frequency or pattern in any other of the longitudinal rows.

* * * * *